US005289929A

United States Patent [19]

Heilman et al.

[11] Patent Number: 5,289,929

[45] Date of Patent: Mar. 1, 1994

[54] TAMPER INDICATING MEANS FOR VACUUM CLOSURES

[75] Inventors: Robert J. Heilman, Orland Park, Ill.; Daniel M. Carson, New York, N.Y.; Robert E. Sparks; Norbert S. Mason, both of St. Louis, Mo.

[73] Assignee: Continental White Cap, Inc., Downers Grove, Ill.

[21] Appl. No.: 887,339

[22] Filed: May 22, 1992

[51] Int. Cl.[5] ..... B65D 55/02

[52] U.S. Cl. ..... 215/230; 215/262; 215/270; 215/365; 116/279; 116/307

[58] Field of Search ..... 215/230, 203, 262, 270, 215/271, 365; 116/279, 307

[56] References Cited

U.S. PATENT DOCUMENTS

| | | | |
|---|---|---|---|
| 3,254,784 | 6/1966 | Lancesseur | 215/230 X |
| 4,502,605 | 3/1985 | Wloszczyna | 215/230 |
| 4,678,082 | 7/1987 | Fillmore | 215/230 X |
| 4,793,500 | 12/1988 | Harding | 215/230 |
| 4,957,211 | 9/1990 | Ekkert et al. | 215/230 |
| 5,018,632 | 5/1991 | Schmidt | 215/230 |
| 5,022,545 | 6/1991 | Carson | 215/230 |
| 5,035,341 | 7/1991 | Heilman et al. | 215/230 |
| 5,074,424 | 12/1991 | Heilman et al. | 215/230 |

*Primary Examiner*—Allan N. Shoap
*Assistant Examiner*—Paul A. Schwarz
*Attorney, Agent, or Firm*—Lockwood, Alex, FitzGibbon & Cummings

[57] ABSTRACT

This relates to the provision of a vacuum actuated button type closure with a tamper indicating arrangement which will visually indicate when a container has been opened or more particularly when the vacuum within a vacuum packed container has been lost. The deflectable button of the closure is utilized to squeeze a dye from a sponge like member into a layer of absorbent material so as to color the absorbent material. The absorbent material, in turn, is provided with non-absorbent areas which define indicia to indicate that an associated container has been opened. The layer of absorbent material is carried by an arched cross sectional cover and in several forms of the cover, a central portion of the cover is downwardly deformable under pressure to move the layer of absorbent material from an inoperative position to a lowered position for cooperation with the sponge like member when the button returns to its up position to effect the flow of the dye from the sponge like member into the layer of absorbent material.

22 Claims, 3 Drawing Sheets

TAMPER INDICATING MEANS FOR VACUUM CLOSURES

This invention relates in general to new and useful improvements in vacuum closures of the type utilizing a button which is drawn down when the closure is applied to a container and the product therein cools, and which closure has internal energy which will automatically return the button to its up position when the vacuum within the container is relieved such as would occur when the container is opened by the removal of the closure. More particularly, this invention relates to providing such a closure with tamper indicating means applied to the closure and in conjunction with the button automatically provides a visual indication that the container has been opened.

BACKGROUND OF THE INVENTION

It is well known to provide vacuum closures which are constructed such that the end panel of each closure is provided with a centrally located button surrounded by an annular hinge portion. The button is normally in an up position and when applied to a hot pack container or other type of container in which a vacuum is formed, will be drawn downwardly by the vacuum to indicate that the container is properly closed. The end panel is provided with stored energy which, when the vacuum is relieved, will cause the button to snap back up to its original position giving off a noise indicating such movement. However, while there may be a sound and visual indication that a container has been opened, if the container has a vacuum again formed therein, such as by reheating, and the closure is replaced, the closure will have the same appearance as a like closure and container wherein the container has never been opened.

SUMMARY OF THE INVENTION

In view of the foregoing, it is proposed to provide a vacuum closure of the type having a vacuum indicating button with tamper indicating means which will be actuated by the return of the button to its up position to visually indicate that the container has been opened. Further, it is desired that the tamper indicating means not be reversible. To this end, it is proposed to provide a cover overlying the button and mounted on the end panel outwardly of the button and its associated hinge formation with the cover carrying a layer of absorbent material having non-absorbent areas defining indicia which will indicate that the container has been opened. There is associated with this layer of absorbent material a sponge like member carrying a suitable dye with the dye being driven from the sponge like member upon the movement of the button to its up position so as to wet the layer of absorbent material and make the non-absorbent indicia thereof stand out to indicate that the container has been opened.

With the above and other objects in view that will hereinafter appear, the nature of the invention will be more clearly understood by reference to the following detailed description, the appended claims, and the several views illustrated in the accompanying drawings.

SHORT DESCRIPTION OF DRAWINGS

DESCRIPTION OF PREFERRED EMBODIMENTS OF THE INVENTION

Figure 1:
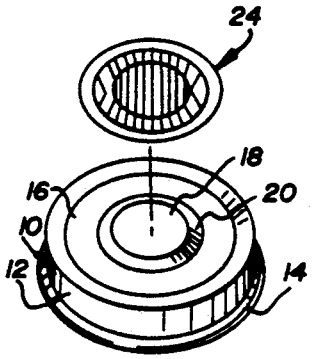
FIG. 1 is an exploded top perspective view of a conventional vacuum closure incorporating a condition indicating button and a cover for such button.
Figure 2:
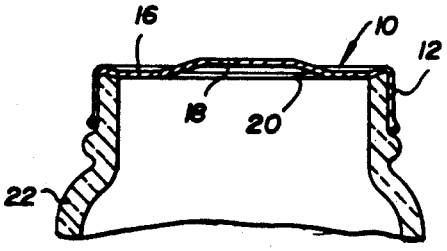
FIG. 2 is a transverse vertical sectional view taken through the closure of FIG. 1 as applied to a container but with the button in its up position.
Figure 3:
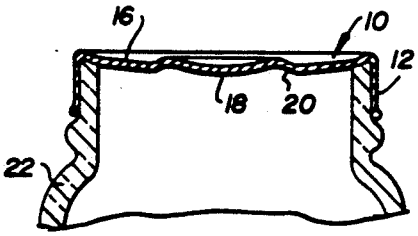
FIG. 3 is a prior art vertical sectional view of the container and closure of FIG. 2 but with the button drawn downwardly by a vacuum formed within the container.

Referring now to the drawings in detail, reference is first made to FIGS. 1–3 wherein there is illustrated a conventional type of closure generally identified by the numeral 10. The closure 10 includes a skirt 12 having at the lower end thereof a curl 14. At its top, the skirt 12 encircles an end panel generally identified by the numeral 16. The end panel 16 is configurated to define a central button 18 which is surrounded by an annular hinge portion 20.

As shown in FIG. 3, when the closure 10 is applied to a container 22 and a vacuum is formed within the container 22, the vacuum draws the button 18 downwardly by a hinging action in the annular portion 20. On the other hand, as shown in FIG. 2, when the vacuum is removed from within the container 22, such as by loosening the closure 10, stored energy within the end panel 16 causes the button 18 to snap to an up position.

As previously described, the closure 10 as illustrated in FIGS. 1-3 is well known prior art. In accordance with this invention, the closure 10 is provided with tamper indicating means of which a cover 24 shown in FIG. 1 is a part.

Figure 4:
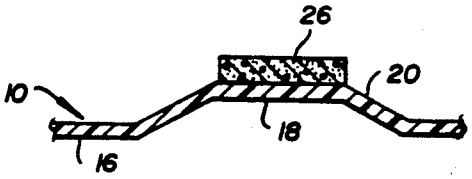
PRIOR ART FIG. 4
FIG. 4 is an enlarged fragmentary vertical sectional view taken through the button of the closure of FIG. 1 and shows the same having a sponge applied thereto.

As is best shown in FIG. 4, the closure 10 is provided with a sponge 26 which is seated on and bonded to the upper surface of the button 18. The sponge like member 26 is particularly adapted to be filled with a suitable colored dye.

In accordance with this embodiment of the invention, after the closure 10 has been applied to a container, such as the container 22, and a vacuum is drawn against the underside of the end panel 16, the button 18 will snap downwardly to its down position by way of a hinging action of the annular portion 20. After this occurs, the required dye is first placed in the sponge like member 26 after which the cover 24 is bonded to the top of the end panel 16 surrounding the annular portion 20. It will be seen here that the cover 24 includes a central portion 30 which is connected to an annular mounting portion 32 by an annular portion 34 which slopes downwardly and radially outwardly from the central portion 30. A disc or layer of absorbent material 36 is bonded to the underside of the cover 24 as is clearly illustrated in FIG. 4. The layer 36 is primarily formed of a suitable absorbent material, but includes non-absorbent areas 38 which define indicia, such as the word——"OPEN"——. It is to be understood that the color of the non-absorbent areas correspond generally to that of the absorbent area whereby the indicia 38 is not readily visible at this time through the cover 24 which is formed of a transparent or translucent plastic material, the cover preferably being formed of a clear plastic.

Figure 5:
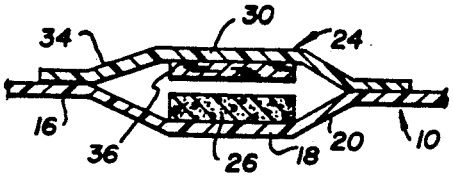
PRIOR ART FIG. 5
FIG. 5 is a fragmentary vertical sectional view similar to FIG. 4 and shows the closure applied to a container with the button being drawn to its down position by vacuum within the container and there being applied to the closure a cover having adhered to the underside thereof a layer of absorbent material.
Figure 7:
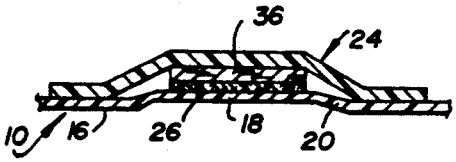
FIG. 7 is a vertical sectional view similar to FIG. 5 and shows the closure after the vacuum has been relieved from within an associated container and the button in an up position with the sponge like member contacting the layer of absorbent material so as to drive dye into the layer of absorbent material.
Figure 6:
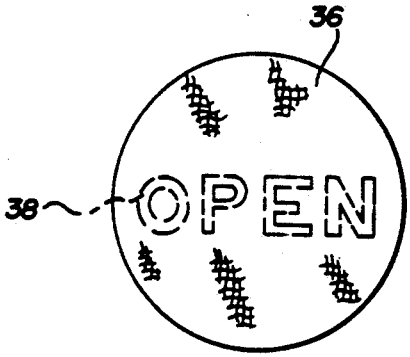
FIG. 6 is a plan view of the layer of absorbent material showing non-absorbent areas of the layer of absorbent material.
Figure 8:
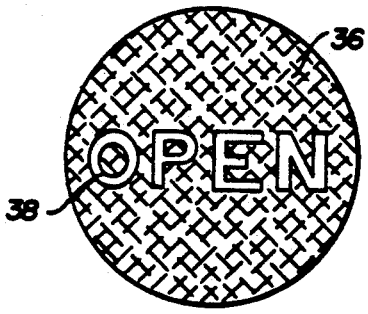
FIG. 8 is a planned view of the layer of absorbent material after it has absorbed the dye showing a color change wherein the indicia defined by the non-absorbent areas clearly stands out.

As is clearly apparent in FIG. 5, the peripheral portion 32 of the cover 24 is bonded to the upper side of the end panel 16. When the cover 24 is applied, the layer 36 of absorbent material is spaced above the sponge like member 26 and is out of contact therewith. However, when the closure 10 is removed from the associated container and the button 18 is no longer held down by the vacuum within an associated container, the stored energy within the end panel 16 results in the button 18 snapping upwardly to its original position of FIG. 4. At this time the sponge like member 26 engages the underside of the layer 36 of the absorbent material and the colored dye carried by the sponge like member 26 is squeezed out and enters into the layer 36 of absorbent material. The result is, as shown in FIG. 8, the absorbent portions of the layer 36 absorbs the dye from the sponge like member 26 and assumes the color of the dye. On the other hand, the non-absorbent areas 38 do not absorb the dye and thus the indicia defined by the non-absorbent areas 38 become clearly visible and indicate that the closure has moved to an open position as is clearly shown in FIG. 8.

The foregoing tamper indicating means has the deficiency in that the dye must be applied to the sponge like member 26 by the packer after the closure 10 has been applied to the container 22 and the button 18 has moved to its down position. Then the packer must also add the cover 24.

While utilizing the basic concept of the tamper indicating means of FIGS. 4-8, it is proposed to provide the closure 10 with tamper indicating means which is in of itself complete and requires only a simple operation by the packer which may be readily performed.

Figure 9:
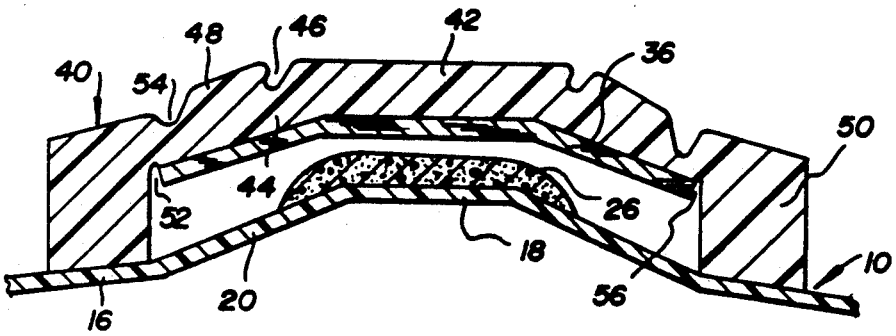
FIG. 9 is a vertical sectional view similar to FIG. 5 through a modified form of tamper indicating means and shows the specific details thereof.

Referring now to FIG. 9, it will be seen that the sponge like member 26, filled with the dye, is applied to the closure 10 with the button 18 in its up position. In a like manner, a modified form of cover, generally identified by the numeral 40 is applied to the end panel 16 in overlying relation. The cover 40, like the cover 24, may be readily stamped out of sheet material. Further, the cover 40 is of an arched configuration as is the cover 24. On the other hand, while the cover 24 is of a fixed cross section, the cover 40 is constructed so as to be downwardly deformable.

Most particularly, the cover 40 includes a circular central panel 42 which is defined by an inner circular hinge 44 formed by a circular groove 46 formed in the upper surface of the cover 40.

An annular portion 48 surrounds the hinge 44 and is joined to a mounting part 50 by an outer circular hinge 52. The hinge 52 is defined by an annular groove 54 formed in the outer surface of the cover 40 and a generally aligned further annular groove 56 formed in the underside of the cover 40.

Figure 11:
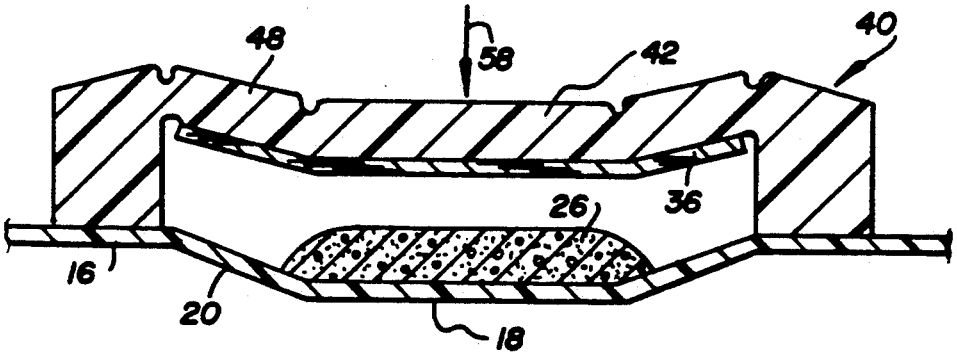
FIG. 11 is another vertical sectional view similar to FIG. 9 and shows the central panel of the cover downwardly depressed towards the sponge like member containing the dye.

Moving at this time to FIG. 11, it will be seen that when the central panel 42 is pressed downwardly as indicated by the arrow 58, the central panel 42 will move downwardly to a down position while the annular portion 48 will move from an inwardly and upwardly sloping position to an inwardly and downwardly sloping position. Thus the central panel 42 can be moved downwardly a distance to meet a requirement which will be described in detail hereinafter.

Returning now to FIG. 9, it will be seen that the cover 40 is provided with the layer 36 of absorbent material having non-absorbent areas 38 defining indicia in the manner previously described.

Most particularly, it will be seen that the arched configuration of the cover 40 spaces the layer 36 of absorbent material above the sponge 26 when the button 18 is initially in its up position prior to the closure 10 being applied to a vacuum packed container.

Figure 10:
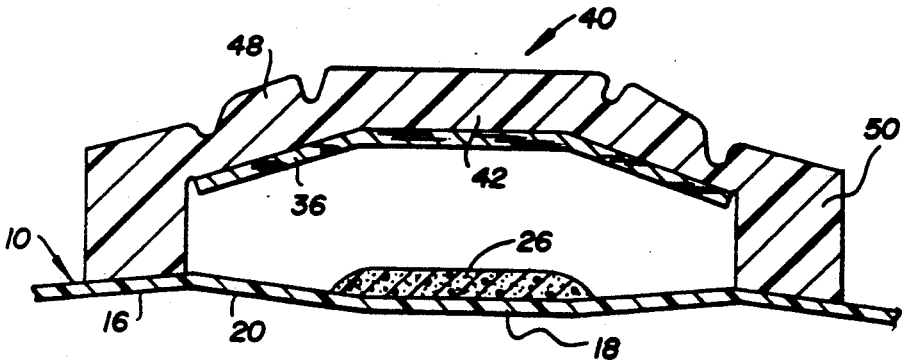
FIG. 10 is a vertical sectional view similar to FIG. 9 and shows the button in its down position after the closure has been in its down position after the closure has been applied to a vacuum packed container.

Reference is now made to FIG. 10 wherein it will be seen that the closure 10 has been applied to a vacuum packed container and the button 18 has been drawn down to its down position by the vacuum formed within such container. The sponge like member 26 is now spaced a considerable distance below the layer 36 of absorbent material. The sponge like member 26 is now in a position wherein the layer 36 of absorbent material can be moved downwardly by deforming the cover 40 as previously described without contacting the sponge like member 26.

Figure 12:
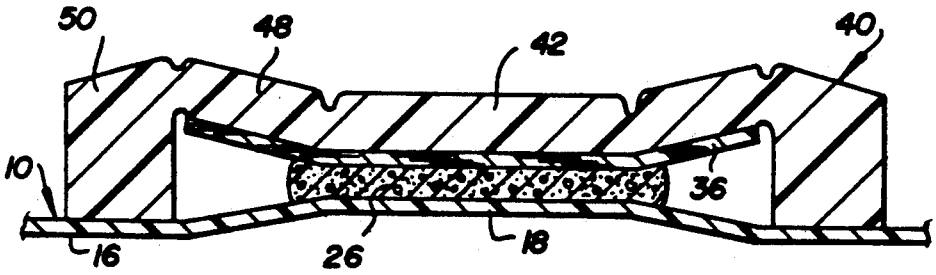
FIG. 12 is yet another vertical sectional view similar to FIG. 9 wherein the button of the closure has again moved upwardly and now clamps the sponge like member against the layer of absorbent material whereby the dye carried by the sponge like member is absorbed by the layer of absorbent material.

On the other hand, as shown in FIG. 12, when the closure 10 is removed from the container or the vacuum within the container is released such as by leakage, and the button 18 snaps up to its original up position, the sponge 26 is forcibly brought into contact with the layer 36 of absorbent material with the dye and the sponge like member 26 being squeezed out of the sponge like member 26 and into the layer of absorbent material 36 to color the layer of absorbent material 36 in the manner shown in FIG. 8 and thus make the indicia defined by the non-absorbent areas 38 stand out.

It is to be understood that since the deformed cover 40 is not returnable to its original position, the action of the button 18 to squeeze the sponge like member 26 against the layer 36 of absorbent material cannot be defeated.

Figure 13:
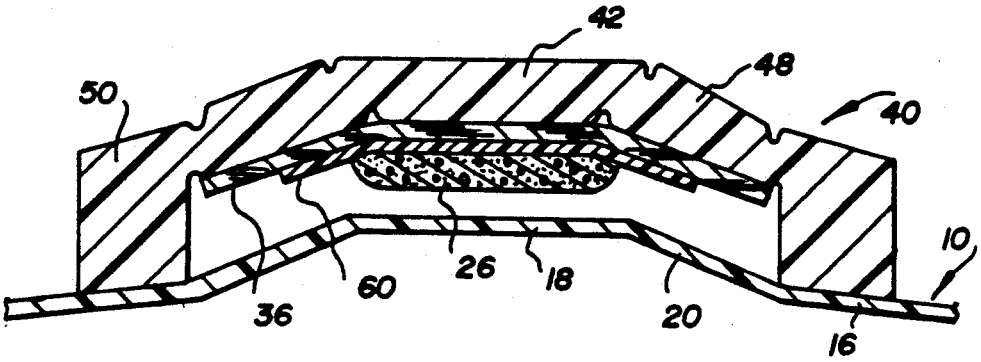
FIG. 13 is a vertical sectional view of still another form of tamper indicating means wherein both the layer of absorbent material and the dye filled sponge is carried by the cover and wherein initially a non-permeable film prevents the dye from the sponge from flowing into the layer of absorbent material.

Reference is now made to FIG. 13 wherein there is illustrated yet another form of tamper indicating means. This tamper indicating means is structurally similar to that of FIGS. 9 through 12 and functions in the same manner. However, it differs in that in lieu of the sponge like member 26 being carried by the button 18, it is carried by the cover 40. Further, it will be seen that there is carried by the underside of the layer 36 of absorbent material a non-permeable film 60 which in turn carries the sponge like member 26. It will be seen that the film 60 is of a size larger than the sponge like member 26 and of a size lesser than that of the layer 36.

In use the steps shown in FIGS. 10, 11 and 12 are practiced with this arrangement. That is, when the closure 10 is applied to a vacuum packed container, the button 18 will be drawn downwardly to its down position as by the vacuum within the container in the manner shown in FIG. 10. Thereafter, the central panel 42 of the cover 40 will be pushed downwardly utilizing some type of automatic equipment. In this position, it will be apparent, that the sponge like member 26 is still spaced above the button 18. However, when the vacuum is relieved within the associated container, such as by removal of the closure 10, the button 18 will snap to its up position in which position it will compressively engage the sponge like member 26 and cause the same to flatten and grow in outline whereby the dye contained therein will flow across and peripherally outwardly of a film 60 into the layer 36 of absorbent material so as to obtain a similar action to that illustrated in FIG. 12.

Although only several forms of tamper indicating arrangements have been specifically illustrated and described herein, it is to be understood that minor variations may be made in the tamper indicating arrangements without departing from the spirit and scope of the invention as defined by the appended claims.

We claim:

1. A tamper indicating closure comprising a closure member having an end panel including an axially deformable vacuum actuated button said button movable between an up position and a down position, a cover having a generally central portion formed in a upwardly extending configuration, said central portion being axially deformable into a downwardly extending configuration, said cover being carried by said end panel in overlying relation to said button, a layer of absorbent material overlying said button, said layer of absorbent material having non-absorbent areas defining message indicia, a sponge like member below said layer of absorbent material, said sponge-like member having a liquid dye therein, said cover and said button operatively associated to clamp said sponge like member and said absorbent material therebetween when said button is in the up position and said central portion of said cover is in said downwardly extending configuration, thereby allowing the liquid dye to color all of said layer of absorbent material except for said non-absorbent areas to make said non-absorbent areas readily visible, and said generally central portion of said cover permitting light to pass through for the purpose of viewing any coloring of said layer of absorbent material.

2. A tamper indicating closure according to claim 1 wherein initially said non-absorbent areas blend in appearance with the remainder of said layer of absorbent material so as to be not readily visible.

3. A tamper indicating closure according to claim 1 wherein said sponge like member is fixedly secured to said button for movement with said button.

4. A tamper indicating closure according to claim 3 wherein said layer of absorbent material is carried by said cover.

5. A tamper indicating closure according to claim 3 wherein said layer of absorbent material is carried by said cover and said cover is arched shaped in cross section.

6. A tamper indicating closure according to claim 3 wherein said layer of absorbent material is carried by said cover and said cover is arched shaped in cross section, and said layer of absorbent material is axially spaced from said sponge like member.

7. A tamper indicating closure according to claim 1 wherein said cover is constructed to be maintained in a permanent down position.

8. A tamper indicating closure according to claim 1 wherein said cover includes a central panel surrounded by an annular portion, an infer circular hinge joins said central panel to said annular portion, and an outer circular hinge joins said annular portion to a remainder of said cover.

9. A tamper indicating closure according to claim 1 wherein said layer of absorbent material and said sponge like member are both carried by said cover.

10. A tamper indicating closure according to claim 9 wherein said sponge like member has dye therein, and said sponge like member is separated from layer of absorbent material by a non-permeable film.

11. A tamper indicating closure according to claim 10 wherein said film is of a size to completely cover said sponge like member in the initial state of said sponge like member and of a size lesser than the size of said sponge like member when flattened by contact with said button whereby said dye flows from said sponge like member around said film and into said layer of absorbent material when said closure is removed from a container.

12. A tamper indicating closure according to claim 11 wherein said cover is configurated to move axially downwardly under axial pressure to a position wherein in the down position of said cover and the up position of said button said sponge like member is flattened.

13. A tamper indicating closure according to claim 1 wherein said layer of absorbent material is carried by said cover.

14. A tamper indicating closure according to claim 13 wherein said layer of absorbent material is carried by said cover and said cover is arched shaped in cross section.

15. A tamper indicating closure according to claim 1 wherein said generally central portion of said cover is transparent.

16. A tamper indicating closure according to claim 1 wherein said generally central portion of said cover is translucent.

17. A tamper indicating closure comprising a closure member having an end panel including an axially deformable button, said button positionable between an up position and a down position, a transparent cover carried by said end panel in overlying relation to said button, said cover being arched shaped in cross section and constructed to move axially downward to a down position, a layer of absorbent material carried by said cover and overlying said button, said layer of absorbent material having non-absorbent areas defining message indicia, and a sponge like member axially spaced form said layer of absorbent material for holding a liquid dye, said sponge like member compressively engaging said layer of absorbent material when said cover is in the down position and said button is in the up position with said dye entering said absorbent material to color all of said layer of absorbent material except for said non-absorbent areas, making said non-absorbent areas readily visible.

18. A tamper indicating closure according to claim 17 wherein said cover includes a central panel surrounded by an annular portion, an inner circular hinge joining said central panel to said annular portion, and an outer circular hinge joining said annular portion to a remainder of said cover.

19. A tamper indicating closure comprising a closure member having an end panel including an axially deformable button, a transparent cover carried by said end panel in overlying relation to said button, a layer of absorbent material overlying said button, said layer of absorbent material having non-absorbent areas defining message indicia, and a sponge like member below said layer of absorbent material for holding a volume of a liquid dye therein, said layer of absorbent material and said sponge like member both carried by said cover, said sponge like member positioned to be clamped between said button and said layer of absorbent material to color all of said layer of absorbent material except for said non-absorbent areas, making said non-absorbent areas readily visible.

20. A tamper indicating closure according to claim 19 wherein said sponge like member has a volume of liquid dye therein and said sponge like member is separated from said layer of absorbent material by a nonpermeable film.

21. A tamper indicating closure according to claim 20 wherein said film is constructed and positioned to completely cover said sponge like member in an initial state and wherein said film is constructed and positioned to allow said dye to flow from said sponge like member and around said film in a second state when said sponge like member is clamped between said button and said layer of absorbent material, thereby allowing said dye to color said layer of absorbent material except for said non-absorbent areas.

22. A tamper indicating closure according to claim 21 wherein said deformable button is positionable between an up position and a down position and said cover is configured to move axially downwardly to a down position such that in the down position of said cover and the up position of said button said sponge like member is clamped therebetween.

* * * * *